US007665508B2

(12) United States Patent
Liu et al.

(10) Patent No.: US 7,665,508 B2
(45) Date of Patent: Feb. 23, 2010

(54) HEAT PIPE

(75) Inventors: Tay-Jian Liu, Tu-Cheng (TW); Chao-Nien Tung, Tu-Cheng (TW); Chuen-Shu Hou, Tu-Cheng (TW); Chih-Hsien Sun, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 385 days.

(21) Appl. No.: 11/309,261

(22) Filed: Jul. 20, 2006

(65) Prior Publication Data

US 2007/0204975 A1 Sep. 6, 2007

(30) Foreign Application Priority Data

Mar. 3, 2006 (CN) ..... 2006 1 0034172

(51) Int. Cl.
*F28D 15/04* (2006.01)
*H05K 7/20* (2006.01)

(52) U.S. Cl. ..... 165/104.21; 165/104.26; 361/700

(58) Field of Classification Search ..... 165/104.21, 165/104.26; 361/700
See application file for complete search history.

(56) References Cited

U.S. PATENT DOCUMENTS

| | | | | | |
|---|---|---|---|---|---|
| 3,568,762 | A * | 3/1971 | Harbaugh | ..... | 165/104.26 |
| 3,683,214 | A * | 8/1972 | Leffert | ..... | 310/10 |
| 3,986,550 | A * | 10/1976 | Mitsuoka | ..... | 165/104.21 |
| 4,281,709 | A * | 8/1981 | Busse | ..... | 165/104.26 |
| 4,336,837 | A * | 6/1982 | Koenig | ..... | 165/104.26 |
| 4,437,510 | A * | 3/1984 | Martorana | ..... | 165/104.26 |
| 6,571,863 | B1 * | 6/2003 | Liu | ..... | 165/104.21 |

FOREIGN PATENT DOCUMENTS

| | | | | | |
|---|---|---|---|---|---|
| JP | 53088255 | A * | 8/1978 | ..... | 165/104.26 |
| RU | 2222757 | C2 | 1/2004 | | |

* cited by examiner

*Primary Examiner*—Leonard R Leo
(74) *Attorney, Agent, or Firm*—Frank R. Niranjan

(57) ABSTRACT

A heat pipe includes a pipe containing phase changeable working media therein. A wick structure is located on an inner face of the pipe. A space is surrounded by the wick structure in the pipe. At least one muzzle with an inlet and an outlet is positioned inside the pipe; the inlet and the outlet are deferent in radius thereof.

8 Claims, 4 Drawing Sheets

HEAT PIPE

FIELD OF THE INVENTION

The present invention relates generally to a heat pipe and a method for manufacturing the heat pipe, and more particularly to a heat pipe having a sintered wick structure and a method for manufacturing such a heat pipe.

DESCRIPTION OF RELATED ART

Heat pipes have excellent heat transfer performance due to their low thermal resistance, and therefore are an effective means for transferring or dissipating heat from heat sources. Currently, the heat pipes are widely used for removing heat from heat-generating components such as central processing units (CPUs) of computers. A heat pipe is generally a vacuum-sealed pipe. A wick structure is provided on an inner wall of the pipe, and the pipe contains at least a phase changeable working media employed to carry heat. Generally, according to positions from which heat is input or output, the heat pipe has three sections: an evaporating section, a condensing section and an adiabatic section between the evaporating section and the condensing section.

In use, the heat pipe transfers heat from one place to another place mainly by virtue of phase change of the working media taking place therein. Generally, the working media is a liquid such as alcohol, water and so on. When the working media in the evaporating section of the heat pipe is heated up, it evaporates, and a pressure difference is thus produced between the evaporating section and the condensing section in the heat pipe. Resultant vapor with high enthalpy rushes to the condensing section and condenses there. Then the condensed liquid reflows to the evaporating section along the wick structure. This evaporating/condensing cycle repeats in the heat pipe. As a consequence of this heat can be continually transferred from the evaporating section to the condensing section. Due to the continual phase change of the working media, the evaporating section is kept at or near the same temperature as the condensing section of the heat pipe. The heat pipe is used widely owing to its great heat-transfer capability.

In the heat pipe, the reflowing condensed liquid is resisted by ascending vapor from the evaporating section; this results in volume of reflowing liquid decreasing, which can lead to dry-out in the evaporating section of the heat pipe. Additionally, due to large ratio of length to radius, large amounts of heat from the vapor is dissipated to ambient air on the way to the condensing section of the heat pipe. Therefore, the vapor is condensed before arrival at the condensing section, which blocks ascension of the vapor to the condensing section. As a result, heat transfer capability of heat pipe can be adversely affected.

Therefore, it is desirable to provide a heat pipe which has greater heat transfer capability.

SUMMARY OF THE INVENTION

A heat pipe in accordance with an embodiment of the present invention comprises a pipe containing phase changeable working media therein. A wick structure is located on an inner face of the pipe. A space is surrounded by the wick structure in the pipe. At least one muzzle with an inlet and an outlet is positioned in the space of the pipe; the inlet and the outlet are different in radius.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
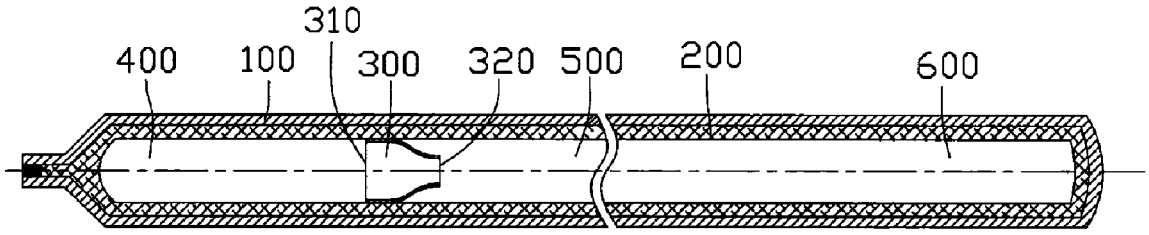
FIG. 1 is a longitudinal cross-sectional view of a heat pipe in accordance with a first embodiment of the present invention.

FIG. 1 illustrates a heat pipe in accordance with a first embodiment of the present invention. The heat pipe comprises an elongated pipe 100 with a circular cross section. The pipe 100 contains right amount of phase changeable working media (not shown) therein. A wick structure 200 is located at an inner face of the pipe 100 for condensing working media flowing therealong. A space (not labeled) is surrounded by the wick structure 200 in the pipe 100, for evaporating working media flowing therein. A muzzle 300 is positioned in the space of the pipe 100, with the evaporating working media flow therethrough.

According to positions from which heat is input or output, the heat pipe is defined with an evaporating section 400, a condensing section 600, and an adiabatic section 500 located between the evaporating section 400 and the condensing section 600.

The muzzle 300 is positioned adjacent to a joint of the evaporating section 400 and the adiabatic section 500, with an inlet 310 thereof extending toward and facing the evaporating section 400 and an outlet 320 thereof extending toward and facing the adiabatic section 500 and the condensing section 600. Still, the muzzle 300 can be entirely positioned at the adiabatic section 500 or the evaporating section 400. The muzzle 300 is tapered from the inlet 310 to the outlet 320, where a diameter of the outlet 320 is smaller than that of the inlet 310; that is to say, the outlet 320 has a cross-sectional area smaller than that of the inlet 310. According to principle of continuity of fluid that a product (Q: denoting a volume of a fluid flowing through a cross section of a pipe per second) of an area (S) of any cross section and a velocity (V) of a fluid flowing through corresponding cross section in a same pipe is a constant. Therefore, according to the equation of continuity of fluid: $Q=S*V$, it is known that the fluid has a larger velocity in the smaller area while it has a smaller velocity in the larger area. For the muzzle 300 of the heat pipe, the evaporated working media has a larger velocity at the outlet 320; therefore, the evaporated working media is accelerated by the muzzle 300 to flow to the condensing section 600. In use, the evaporating section 400 absorbs heat from a heat source, the working media in the evaporating section 400 is heated up, it evaporates, and pressure difference is thus produced between the evaporating section 400 and the condensing section 600. Resultant vapor with high enthalpy rushes to the muzzle 300, and passes through the muzzle 300 from the inlet 310 to the outlet 320 to thereby be accelerated with a larger velocity rushing to the condensing section 600 via the adiabatic section 500. The vapor releases heat to ambient air and is condensed at the condensing section 600. Then the condensed liquid reflows to the evaporating section 400 along the wick structure 200. This evaporating/condensing cycle repeats in the heat pipe.

Figure 2:
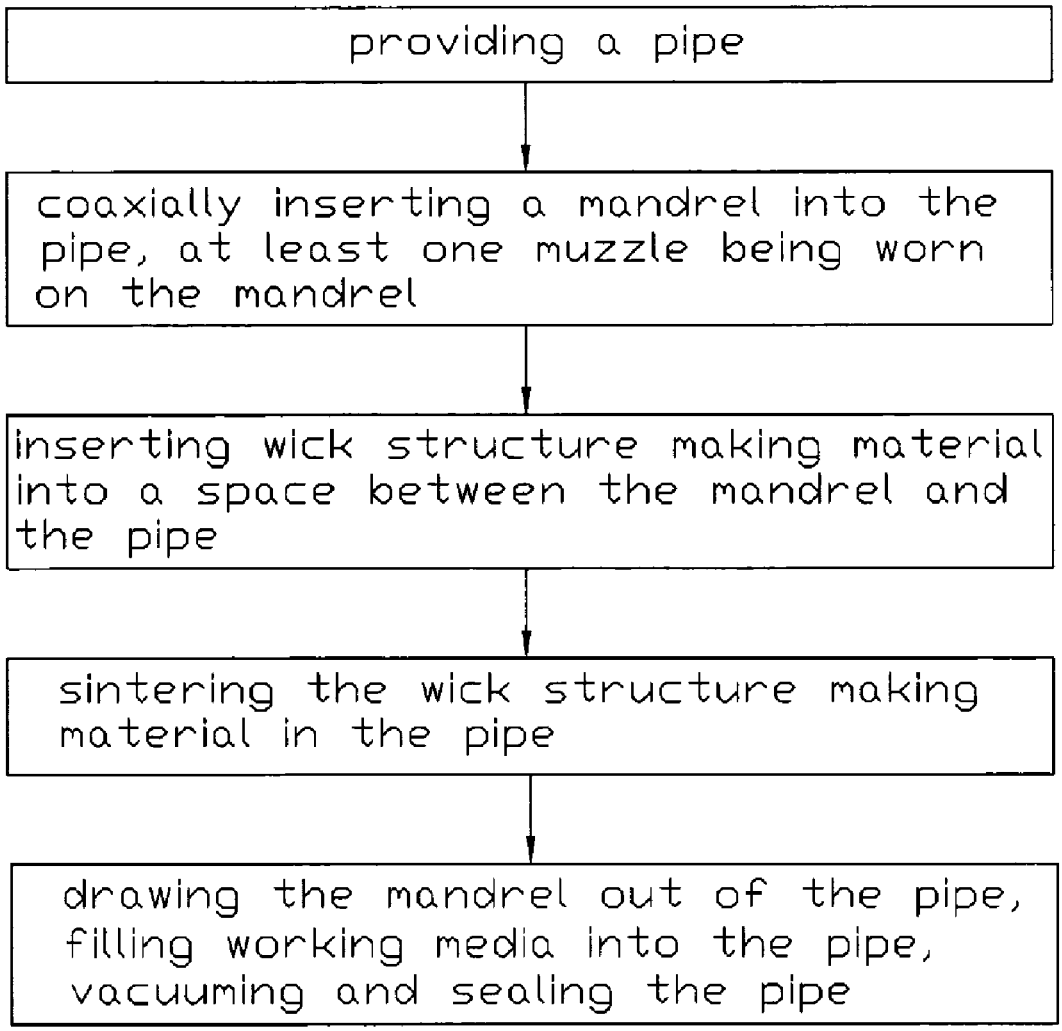
FIG. 2 is a flow chart of manufacturing the heat pipe in accordance with the first embodiment of the present invention.

Referring to FIG. 2, a method of manufacturing the aforementioned heat pipe comprises the following steps: 1) providing the pipe 100; 2) coaxially inserting a mandrel into the pipe 100, the muzzle 300 being coaxially fitted on the mandrel and being located adjacent to an end of the mandrel; 3) inserting wick structure making material into a space between the mandrel and the pipe; 4) sintering the wick structure making material in the pipe; 5) drawing the mandrel out of the pipe, leaving the muzzle 300 positioned inside the pipe, filling working media into the pipe, vacuuming and sealing the pipe.

Figure 3:
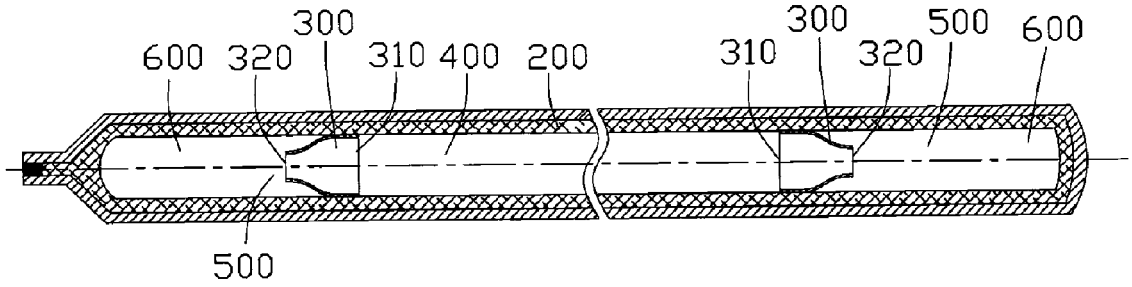
FIG. 3 is a longitudinal cross-sectional view of a heat pipe in accordance with a second embodiment of the present invention.

Referring to FIG. 3, a heat pipe in accordance with a second embodiment of the present invention is illustrated. Different from the first embodiment of the present invention, the heat pipe comprises the evaporating section 400 located in a central portion thereof, two condensing sections 600 located at two end portions thereof, and two adiabatic sections 500 located between corresponding condensing sections 600 and the evaporating section 400. Two muzzles 300 are positioned adjacent to joints of the evaporating section 400 and the adiabatic sections 500, and has the outlets 320 thereof toward corresponding condensing sections 600.

Figure 4:
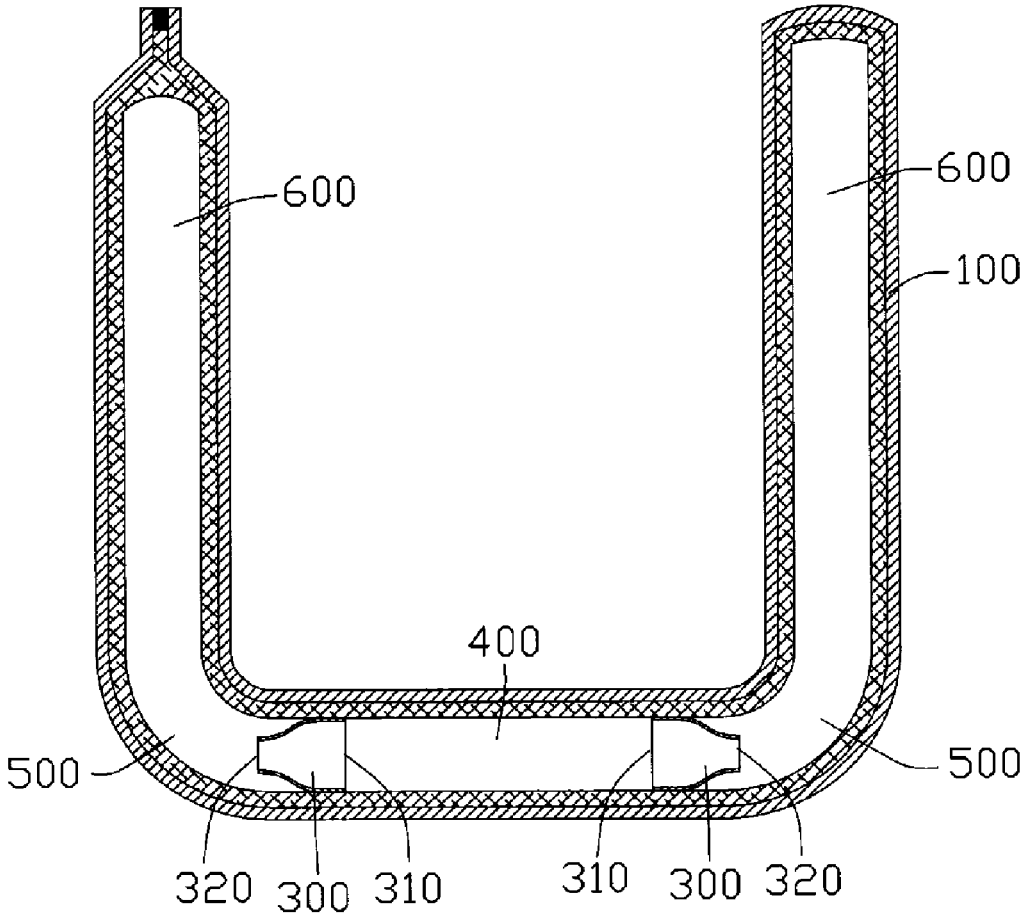
FIG. 4 is a longitudinal cross-sectional view of a heat pipe in accordance with a third embodiment of the present invention.

Referring to FIG. 4, a heat pipe in accordance with a third embodiment of the present invention is illustrated. The heat pipe is U-shaped, and can be obtained by bending the heat pipe of the second embodiment of the present invention. The two condensing sections 600 are parallel to each other and perpendicular to the evaporating section 400. The two adiabatic sections 500 are arced and connect their corresponding condensing sections 600 and the evaporating section 400. The muzzles 300 are positioned in the evaporating section 400 adjacent to the adiabatic sections 500 and have the outlet 320 thereof toward the corresponding adiabatic sections 500.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a pipe containing phase changeable working media therein, the working media being phase changeable between liquid and vapor, a wick structure being located on an inner face of the pipe, a space being surrounded by the wick structure in the pipe, at least one muzzle with an inlet and an outlet being positioned in space of the pipe, the inlet and the outlet being different in radius thereof, the space being for pass of the vapor in the heat pipe from one end to another end of the heat pipe;

wherein the pipe defines an evaporating section, a condensing section and an adiabatic section located between the evaporating section and the condensing section, the inlet of the at least one muzzle extending toward the evaporating section and the outlet of the at least one muzzle extending toward the condensing section;

wherein the muzzle is continuously decreasing in radius from the inlet to the outlet and thus has a radius at the inlet larger than a radius at the outlet;

wherein the muzzle is located adjacent to a joint of the evaporating section and the adiabatic section, without extending over an entirety of the adiabatic section and without extending into any part of the condensing section.

2. The heat pipe of claim 1, wherein the pipe has a circular cross section.

3. The heat pipe of claim 1, wherein the pipe is elongated, and wherein the evaporating section and the condensing section are at two corresponding ends of the pipe.

4. The heat pipe of claim 1, wherein the pipe is elongated and defines two condensing sections at two corresponding ends thereof, wherein the evaporating section is at a middle portion of the pipe, two adiabatic sections connecting corresponding condensing sections and the evaporating section.

5. The heat pipe of claim 1, wherein the pipe is U-shaped and defines two condensing sections substantially parallel to each other, wherein the evaporating section is perpendicular to the two condensing sections, with two arced adiabatic sections connecting corresponding condensing sections and the evaporating section.

6. A heat pipe comprising:

a pipe having an evaporating section for receiving heat, a condensing section for releasing the heat and an adiabatic section located between the evaporating section and the condensing section;

a vapor passage defined in the heat pipe for pass of vapor from the evaporating section to the condensing section; and a muzzle mounted in the vapor passage and having an inlet and an outlet, wherein the inlet has a size larger than that of the outlet, and wherein the vapor flows from the evaporating section, the inlet and then the outlet to reach the condensing section;

wherein the muzzle is continuously decreasing in radius from the inlet to the outlet and thus has a radius at the inlet larger than a radius at the outlet; and wherein the muzzle is located adjacent to a joint of the evaporating section and the adiabatic section, without extending over an entirety of the adiabatic section and without extending into any part of the condensing section.

7. The heat pipe of claim 6, wherein the evaporating section is located at a middle portion of the pipe and the condensing section is located at two opposite ends of the pipe.

8. The heat pipe of claim 7, wherein the pipe has a U-shaped configuration.

* * * * *

UNITED STATES PATENT AND TRADEMARK OFFICE

CERTIFICATE OF CORRECTION

PATENT NO. : 7,665,508 B2
APPLICATION NO. : 11/309261
DATED : February 23, 2010
INVENTOR(S) : Liu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 603 days.

Signed and Sealed this

Seventh Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,508 B2
APPLICATION NO. : 11/309261
DATED : February 23, 2010
INVENTOR(S) : Tay-Jian Liu et al.

It is certified that error appears in the above-identified patent and that said Letters Patent is hereby corrected as shown below:

On the Title Pg and Col. 1 line 1 please replace Item (54) regarding "TITLE" with the following:

Item (54) HEAT PIPE AND METHOD FOR MANUFACTURING THE SAME

On the Title Page:

The first or sole Notice should read --

Subject to any disclaimer, the term of this patent is extended or adjusted under 35 U.S.C. 154(b) by 603 days.

Signed and Sealed this

Fourteenth Day of December, 2010

David J. Kappos

David J. Kappos
*Director of the United States Patent and Trademark Office*